US010309201B1

(12) United States Patent
Hill, Jr.

(10) Patent No.: US 10,309,201 B1
(45) **Date of Patent: *Jun. 4, 2019**

(54) METHOD, APPARATUS, AND SYSTEM FOR INJECTING CHEMICALS INTO LOWER TERTIARY WELLS

(71) Applicant: Tejas Research & Engineering LLC, The Woodlands, TX (US)

(72) Inventor: Thomas G. Hill, Jr., The Woodlands, TX (US)

(73) Assignee: Tejas Research & Engineering LLC, The Woodlands, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/155,559

(22) Filed: Oct. 9, 2018

Related U.S. Application Data

(63) Continuation of application No. 15/815,873, filed on Nov. 17, 2017, now Pat. No. 10,119,375.

(51) Int. Cl.
*E21B 41/00* (2006.01)
*E21B 43/16* (2006.01)

(52) U.S. Cl.
CPC ..... *E21B 43/162* (2013.01); *E21B 41/0007* (2013.01)

(58) Field of Classification Search
CPC ..... E21B 41/0007; E21B 43/16; E21B 43/162
See application file for complete search history.

(56) References Cited

U.S. PATENT DOCUMENTS 2,556,867 A * 6/1951 Carlisle ..... E21B 43/123 137/155
3,993,129 A * 11/1976 Watkins ..... E21B 34/08 166/319
4,326,585 A * 4/1982 McStravick ..... E21B 41/02 166/188
4,399,871 A 8/1983 Adkins et al.
(Continued)

OTHER PUBLICATIONS

International search report of International Search Authority (USPTO) for PCT International Application No. PCT/US2018/055543 dated Dec. 26, 2018.

(Continued)

*Primary Examiner* — Matthew R Buck
(74) *Attorney, Agent, or Firm* — Basil M. Angelo; Angelo IP

(57) ABSTRACT

A chemical injection mandrel for injecting chemicals into a Lower Tertiary well includes a chemical injector disposed on an exterior surface of a mandrel. The chemical injection mandrel connects to the production tubing such that the chemical injector portion of the chemical injection mandrel is disposed in the annulus between the production tubing and wellbore at or near the bottom of the hole. A floating production storage and offloading unit on the surface of the water may include a chemical injection pump that injects chemicals downhole via a chemical fluid line that runs in the annulus between the production tubing and the wellbore. The chemical fluid line connects to the chemical injector portion of the chemical injection mandrel and delivers chemicals to the interior passageway of the mandrel of the chemical injection mandrel where the chemicals mix with the production flow directed to the surface.

8 Claims, 10 Drawing Sheets

(56) References Cited

U.S. PATENT DOCUMENTS

| | | | | |
|---|---|---|---|---|
| 6,009,950 | A * | 1/2000 | Cunningham | E21B 33/038 166/344 |
| 6,880,639 | B2 * | 4/2005 | Rhodes | E21B 34/08 166/321 |
| 7,341,108 | B2 * | 3/2008 | Naizer | E21B 27/02 137/535 |
| 7,909,101 | B2 * | 3/2011 | Conrad | E21B 43/25 166/300 |
| 8,695,706 | B2 * | 4/2014 | Conrad | E21B 43/25 166/300 |
| 9,453,389 | B2 * | 9/2016 | Anderson | E21B 37/06 |
| 2005/0109500 | A1 | 5/2005 | Naizer et al. | |
| 2008/0066919 | A1 | 3/2008 | Conrad | |
| 2010/0096127 | A1 * | 4/2010 | Jordy | E21B 34/08 166/269 |
| 2015/0240601 | A1 * | 8/2015 | Woodford | E21B 34/08 166/305.1 |
| 2017/0254177 | A1 * | 9/2017 | Woodford | E21B 34/10 |

OTHER PUBLICATIONS

Written Opinion of International Search Authority (USPTO) for PCT International Application No. PCT/U32018/055543 dated Dec. 26, 2018.

* cited by examiner

METHOD, APPARATUS, AND SYSTEM FOR INJECTING CHEMICALS INTO LOWER TERTIARY WELLS

CROSS-REFERENCE TO RELATED APPLICATIONS

This application is a continuation of U.S. patent application Ser. No. 15/815,873, filed on Nov. 17, 2017, which is hereby incorporated by reference in its entirety.

BACKGROUND OF THE INVENTION

Many conventional sources of oil and gas production are on the decline. As a result, it has become more difficult and expensive to extract these reserves. To meet expected demand, the industry has increasingly focused on unconventional sources as it has become more technically and economically feasible to do so. According to the International Energy Agency, at least 10% of the remaining recoverable conventional oil and gas reserves lie below the seafloor in deep water. In offshore drilling operations, a drilling rig is typically used to drill a wellbore to recover oil or gas reserves disposed below the seafloor. The offshore facilities may include bottom founded, floating, or mobile drilling rigs and production platforms. In ultra-deepwater operations, drilling and production is conducted in water depths between 5,000 and 10,000 feet or more. Conventionally, offshore operations drill wellbores having a measured depth in excess of 10,000 feet.

The Lower Tertiary is an informal designation for a layer of the Earth's crust deposited during the Paleogene period, between 65 and 23 million years ago. The Gulf of Mexico's Lower Tertiary is considered one of the largest ultra-deepwater oil and gas reserves. According to recent estimates, the Gulf of Mexico's Lower Tertiary is believed to contain between 10 and 40 billion barrels of oil equivalent ("BBOE"). This is significant given that the total estimate of U.S. oil and gas reserves is currently estimated to be approximately 30 BBOE. However, extracting oil and gas from the Lower Tertiary presents a number of technical and economic challenges. To access these reserves, ultra-deepwater drilling operations must deal with water depths up to 10,000 feet or more and drill a further 15,000 to 30,000 feet or more below the seafloor, often under thick sheets of salt, to reach Lower Tertiary reserves. At depth, the downhole temperature may exceed 400° F. and formation pressure may exceed 25,000 pounds per square inch ("PSI") further complicating production activities, including chemical injection.

BRIEF SUMMARY OF THE INVENTION

According to one aspect of one or more embodiments of the present invention, a chemical injector for injecting chemicals into a Lower Tertiary well includes a housing and a chemical injection port. The housing includes a first threaded opening that extends into a portion of a first cavity, a second threaded opening that extends into a portion of a second cavity, a control port that fluidly connects the first cavity to the second cavity, and a communication port that fluidly connects the second cavity to a chemical outlet port. The chemical injection port includes an inlet end configured to receive fluid flow and an outlet end that directs the fluid flow to the control port. The chemical injection port is inserted into the first threaded opening. A bottom plug is inserted into the second threaded opening. A bellows having a first distal end connected to the bottom plug and a second distal end connected to a dart configured to controllably open and close the communication port. An application of a predetermined amount of fluid pressure to the chemical injection port compresses the bellows and withdraws the dart from the communication port, allowing fluid flow to the chemical outlet port.

According to one aspect of one or more embodiments of the present invention, a chemical injection mandrel for injecting chemicals into a Lower Tertiary well includes a mandrel and a chemical injector disposed on an exterior surface of the mandrel. The mandrel includes a hollow interior passageway and a mandrel injection port. The chemical injector includes a housing. The housing includes a first threaded opening that extends into a portion of a first cavity, a second threaded opening that extends into a portion of a second cavity, a control port that fluidly connects the first cavity to the second cavity, and a communication port that fluidly connects the second cavity to a chemical outlet port. The chemical injector includes a chemical injection port having an inlet end configured to receive fluid flow and an outlet end that directs the fluid flow to the control port. The chemical injection port is inserted into the first threaded opening. The chemical injector includes a bottom plug inserted into the second threaded opening and a bellows having a first distal end connected to the bottom plug and a second distal end connected to a dart configured to controllably open and close the communication port. Application of a predetermined amount of fluid pressure to the chemical injection port compresses the bellows and withdraws the dart from the communication port, allowing fluid flow to the chemical outlet port and into the hollow interior passageway of the mandrel via the mandrel injection port.

According to one aspect of one or more embodiments of the present invention, a subsea system for injecting chemicals into a Lower Tertiary well includes a fluid system disposed on a floating production storage and offloading unit, production tubing disposed in a wellbore, a chemical injection mandrel disposed on a distal or near-distal end of the production tubing, and a chemical injection line disposed in an annulus between the production tubing and the wellbore that fluidly connects the fluid system and a chemical injector of the chemical injection mandrel. The chemical injection mandrel includes a mandrel having a hollow interior passageway and a mandrel injection port. The chemical injector is disposed on an exterior surface of the mandrel. The chemical injector includes a housing. The housing includes a first threaded opening that extends into a portion of a first cavity, a second threaded opening that extends into a portion of a second cavity, a control port that fluidly connects the first cavity to the second cavity, and a communication port that fluidly connects the second cavity to a chemical outlet port. The chemical injector includes a chemical injection port having an inlet end configured to receive fluid flow from the chemical injection line and an outlet end that directs the fluid flow to the control port. The chemical injection port is inserted into the first threaded opening. The chemical injector includes a bottom plug inserted into the second threaded opening, and a bellows having a first distal end connected to the bottom plug and a second distal end connected to a dart configured to controllably open and close the communication port. An application of a predetermined amount of fluid pressure to the chemical injection port compresses the bellows and withdraws the dart from the communication port, allowing fluid flow to the chemical outlet port and into the hollow interior passageway of the mandrel via the mandrel injection port.

According to one aspect of one or more embodiments of the present invention, a method of injecting chemicals into a Lower Tertiary well includes connecting a chemical injection line between a fluid system and a chemical injector of a chemical injection mandrel, attaching the chemical injection mandrel to a distal or near-distal end of production tubing, disposing the production tubing into a wellbore, wherein the chemical injection line is disposed in an annulus between the production tubing and the wellbore, and applying fluid pressure in the chemical injection line to enable fluid flow through the chemical injector of the chemical injection mandrel and into a hollow interior passageway of a mandrel of the chemical injection mandrel.

According to one aspect of one or more embodiments of the present invention, a chemical injection mandrel for injecting chemicals through an annularly disposed control line includes a housing attached to production tubing and a chemical injector disposed in the housing. The chemical injector includes a seat, a dart, biasing means, and a porting system. The biasing means biases the dart on seat. The porting system uses hydrostatic pressure in the control line to assist keeping the dart on seat. The porting system directs fluid from the control line to unseat the dart when fluid is to be provided downhole.

Other aspects of the present invention will be apparent from the following description and claims.

DETAILED DESCRIPTION OF THE INVENTION

Figure 1A:
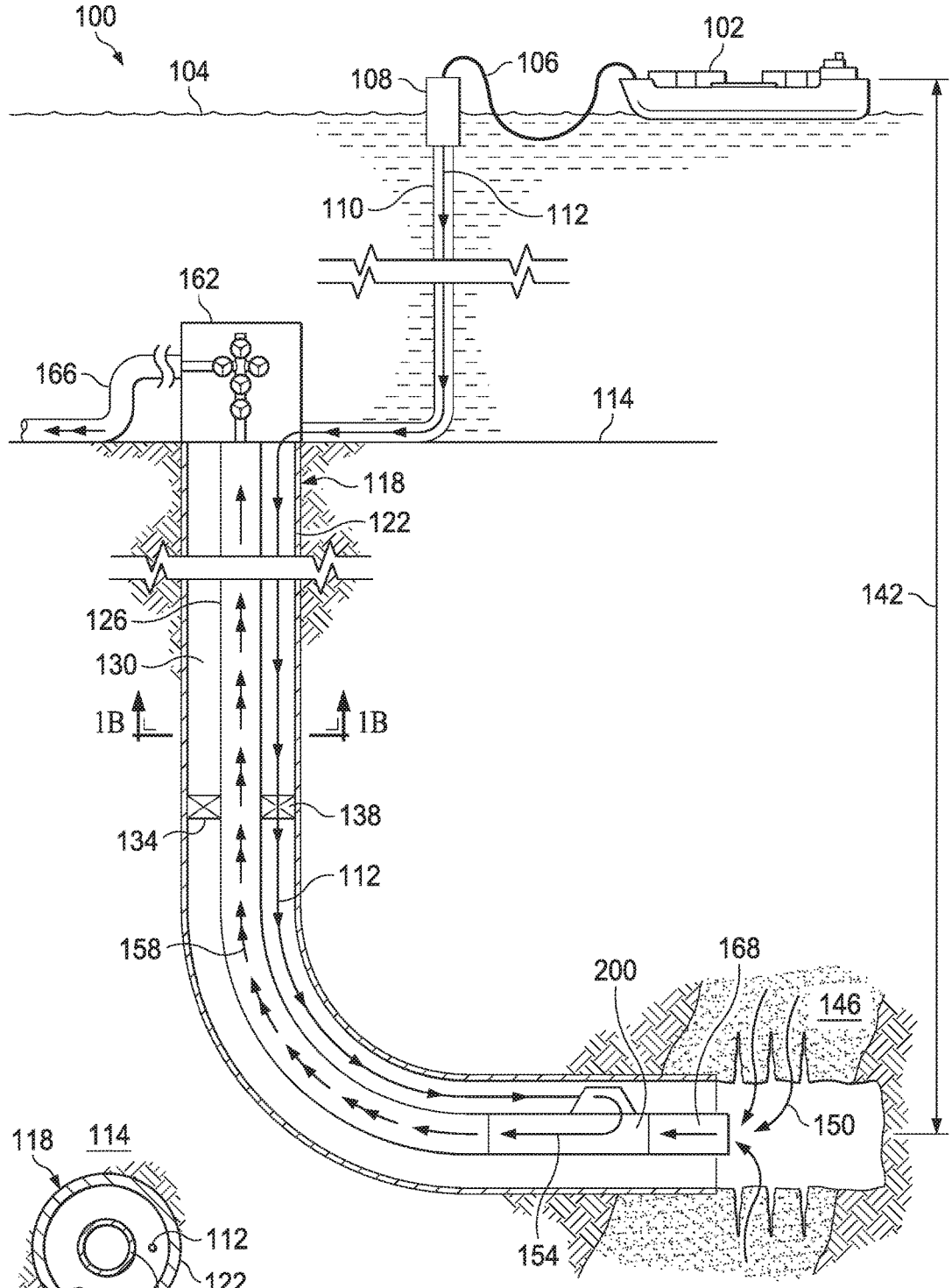
FIG. 1A shows a subsea system for injecting chemicals into a Lower Tertiary well in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

During production operations, chemicals are injected downhole to optimize production flow and minimize the need for expensive interventions. Conventional chemical injection systems are used to inject various chemicals including, for example, corrosion and scale inhibitors, surfactants, asphaltines, hydrates, emulsions, demulsifiers, scavengers, paraffins, weighting agents, and other chemicals. In various operations, expensive chemicals are continuously provided downhole. When the hydrostatic pressure of the wellbore is balanced by the formation pressure, chemicals can be injected at a fairly uniform rate controlled by the chemical injection pump. However, over time, when the formation pressure drops as a result of production, the pressure imbalance causes the formation to syphon chemicals at a substantially higher rate than desired, potentially up to ten times the normal amount, at substantial expense.

In land-based wells, conventional chemical injection systems use a chemical injection pump to inject chemicals downhole via a chemical injection mandrel disposed within the production tubing. Certain conventional chemical injection mandrels reduce chemical flow when the hydrostatic pressure falls to prevent the syphoning of chemicals downhole. These conventional chemical injection mandrels are disposed within the production tubing and at substantially shallower depths. However, they are not suitable for use in ultra-deepwater wells drilled in the Lower Tertiary. Because of the downhole temperature, the downhole pressure, and the hydrostatic head, conventional chemical injection systems are sensitive to production tubing pressure and cannot operate in the harsh conditions where the temperature may exceed 400° F. and pressures may exceed 25,000 PSI. To date, there is no known chemical injection system for effectively injecting chemicals bottomhole in the Lower Tertiary. As such, there is a long felt and unsolved need in the industry for a chemical injection method, apparatus, and system for wells drilled in the Lower Tertiary.

Accordingly, in one or more embodiments of the present invention, a method, apparatus, and system for injecting chemicals into a Lower Tertiary well allows for the efficient and controlled delivery of chemicals downhole in a manner that is production tubing pressure insensitive. A chemical injection mandrel includes a chemical injector disposed on an exterior surface of a mandrel. The chemical injection mandrel connects to the production tubing, such that the chemical injector portion of the chemical injection mandrel is disposed in the annulus between the production tubing and the wellbore. A floating production storage and offloading ("FPSO") unit on the surface of the water may include a chemical injection pump that injects chemicals downhole via a chemical fluid line that runs in the annulus between the production tubing and the wellbore. The chemical fluid line connects to the chemical injector portion of the chemical injection mandrel and delivers chemicals to the interior passageway of mandrel of the chemical injection mandrel where the chemicals mix with the production flow directed to the surface. Advantageously, the method, apparatus, and system for injecting chemicals into a Lower Tertiary well allow for the efficient and controlled delivery of expensive chemicals downhole in a manner that is pressure insensitive.

FIG. 1A shows a subsea system 100 for injecting chemicals into a Lower Tertiary well in accordance with one or more embodiments of the present invention. During ultra-deepwater operations in the Lower Tertiary, a FPSO 102 may be disposed on the surface of the water 104. An umbilical 106 may connect a fluid system (not shown) disposed on the FPSO 102 to a header 108. The header 108 may connect umbilical 106 to a subsea umbilical 110 that may be connected to a subsea wellhead 162, disposed at a depth of 5,000 feet or more. The subsea umbilical 110 may include a chemical injection line 112 that is directed into a wellbore 118 drilled into the subsea ground 114. The wellbore 118 may have a measured depth in excess of 15,000 feet and perhaps as much as 30,000 feet or more, to allow access to Lower Tertiary reserves. A portion of the wellbore 118 may be cased 122 up to a certain depth, substantially shallower than the measured depth of the well. The chemical injection line 112 may be disposed in the annulus 130 between production tubing 126 and wellbore 118. At a certain depth, one or more packers 130 with a feed-through port 138 may be disposed in the annulus between production tubing 126 and casing 122 to seal annulus 130. Feed-through port 138 may allow chemical injection line 112 to bypass packer 130 while maintaining the annular 130 seal.

A chemical injection mandrel 200 may be disposed on a distal or near-distal end of production tubing 126 downhole. The chemical injection line 112 may fluidly connect a fluid system (not shown) disposed on the FPSO 102 on the surface of the water 104 to the chemical injection mandrel 200, the connection being made in the annulus 130 (see, for example, FIG. 1B). The specific gravity of the chemical in the chemical injection line 112 creates a pressure head 142 between the FPSO 102 and the formation 146. The pressure head 142 is balanced by the formation 146 pressure. As pressure in the formation 146 declines over time, the pressure head 142 increases, creating a syphoning of the chemical. In the Lower Tertiary, conditions at the bottom of the wellbore 118 may be extremely harsh. Temperatures may exceed 400° F. and pressures may exceed 25,000 PSI. In addition, various parts of the formation (not independently illustrated) may exhibit different temperatures and pressures and the temperatures and pressures may change over time. As discussed in the background, changes in formation pressure may result in a syphoning action that draws substantially more chemicals if the chemical injection system is sensitive to wellbore pressure.

Figure 1B:
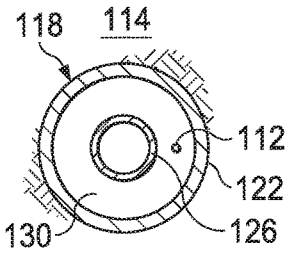
FIG. 1B shows a cross-section of the wellbore showing the chemical injection line for the chemical injection mandrel in the annulus between the production tubing and the wellbore in accordance with one or more embodiments of the present invention.

In one or more embodiments of the present invention, the chemical injection mandrel 200 allows for the efficient and controlled delivery of chemicals 154 downhole in a manner that is pressure insensitive. In certain embodiments, the hydrostatic head 142 acts through a porting system comprised of one or more control ports (408 of FIG. 4), a communication port (416 of FIG. 4), and a chemical outlet (412 of FIG. 4) to keep a dart (228 of FIG. 5A) on seat (small opening of communication port 416 of FIG. 4) instead of acting to open it. The fluids system (not shown) disposed on the FPSO 102 may direct chemicals 154 through chemical injection line 112 into chemical injection mandrel 200. Upon the application of a predetermined amount of fluid pressure in chemical injection line 112, chemical injection mandrel 200 may direct chemicals 154 into an interior passageway of a mandrel (not independently illustrated) of chemical injection mandrel 200 via a mandrel injection port (not independently illustrated). The chemicals 154 may then mix with production flow 150 from the formation. The mixture 158 of the chemicals 154 and the production flow 150 may return to the surface via the subsea wellhead 162 and a production flow line 166 that may be directed to the FPSO 102 for further processing or storage. Because of the design of the chemical injection mandrel 200 and disposition of the chemical injector portion of chemical injection mandrel 200 and chemical injection line 112 in the annulus 130, the application of fluid pressure, and the injection of chemicals at or near the bottom of the hole, is tubing pressure insensitive. As such, the fluid flow rate of chemicals 154 may be controlled by the fluids system (not shown) disposed on the FPSO 102, independent of the tubing pressure or changes therein. Continuing, FIG. 1B shows a cross-section of the wellbore 118 showing the chemical injection line 112 for the chemical injection mandrel 200 in the annulus 130 between the production tubing 126 and the wellbore 118 in accordance with one or more embodiments of the present invention.

Figure 2A:
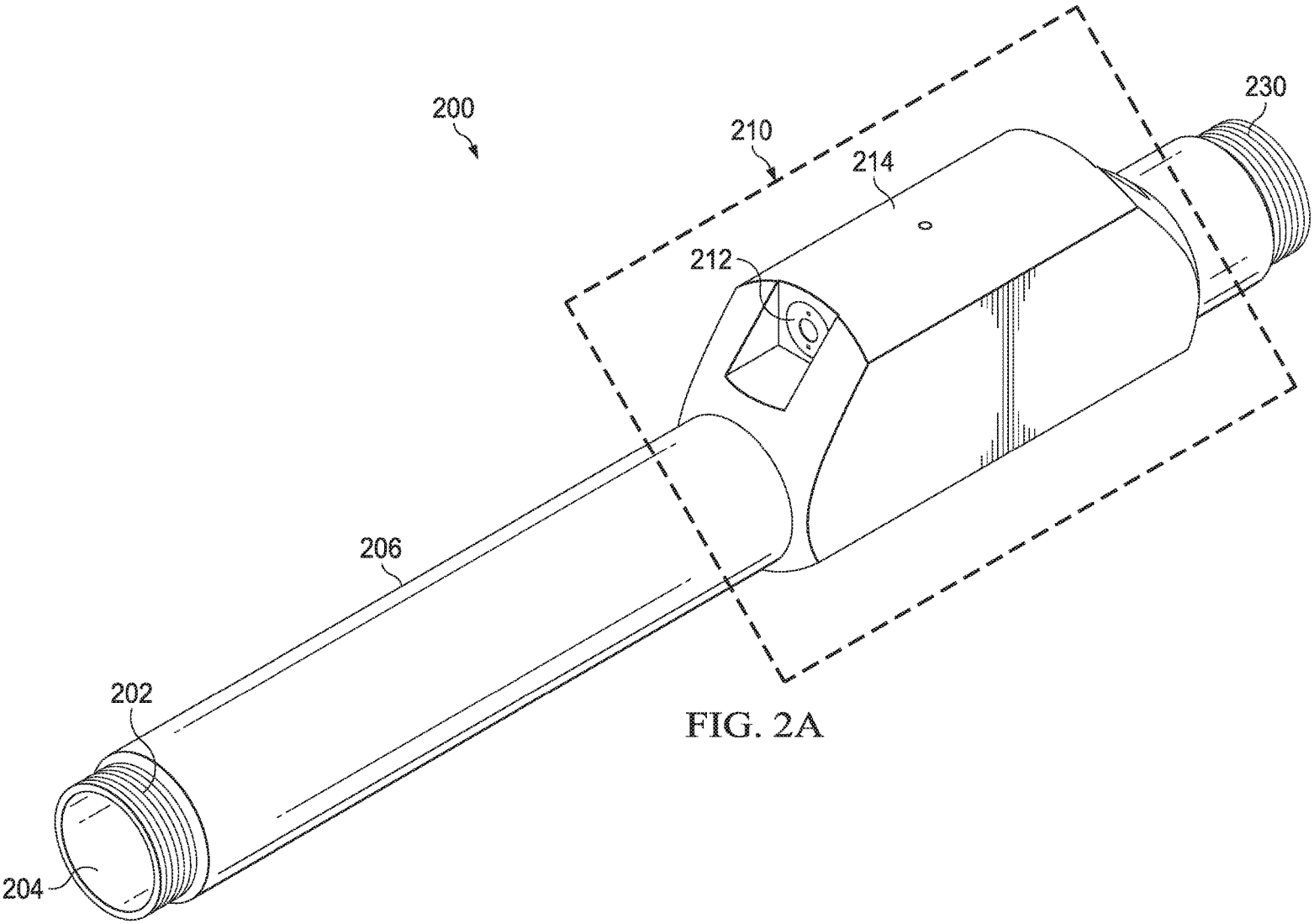
FIG. 2A shows a front-facing perspective view of a chemical injection mandrel in accordance with one or more embodiments of the present invention.
Figure 2B:
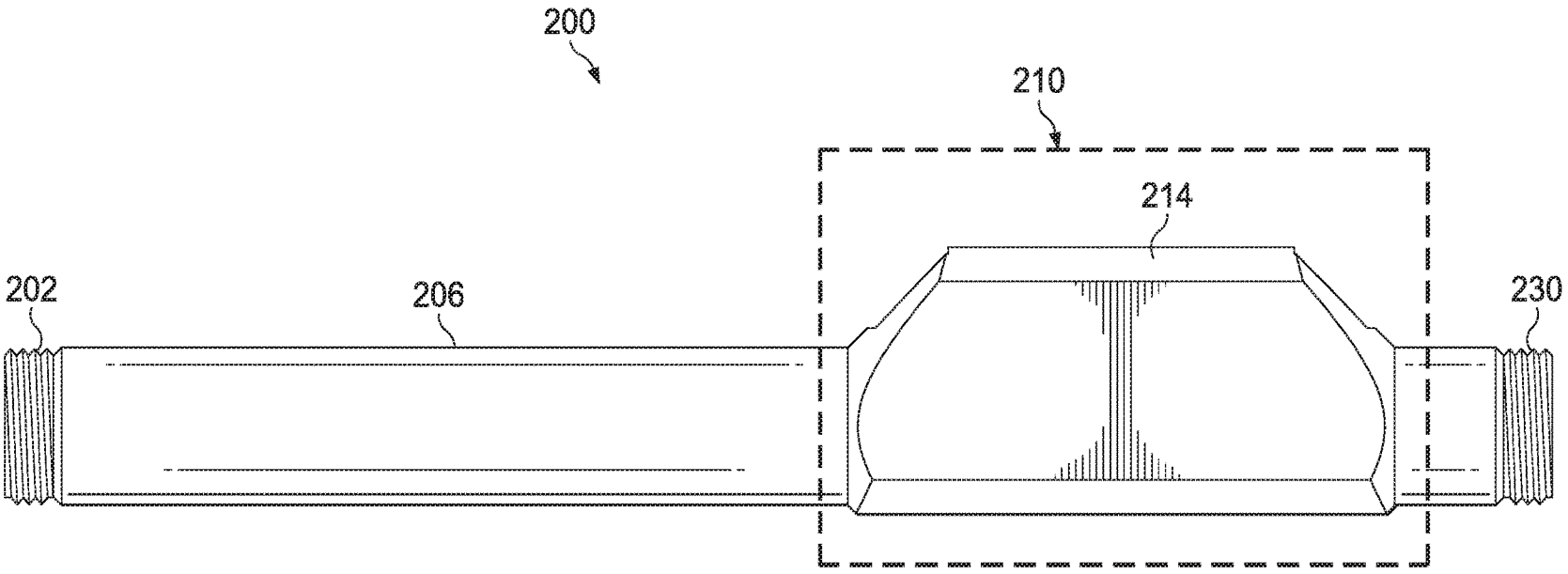
FIG. 2B shows a side elevation view of the chemical injection mandrel in accordance with one or more embodiments of the present invention.
Figure 2C:
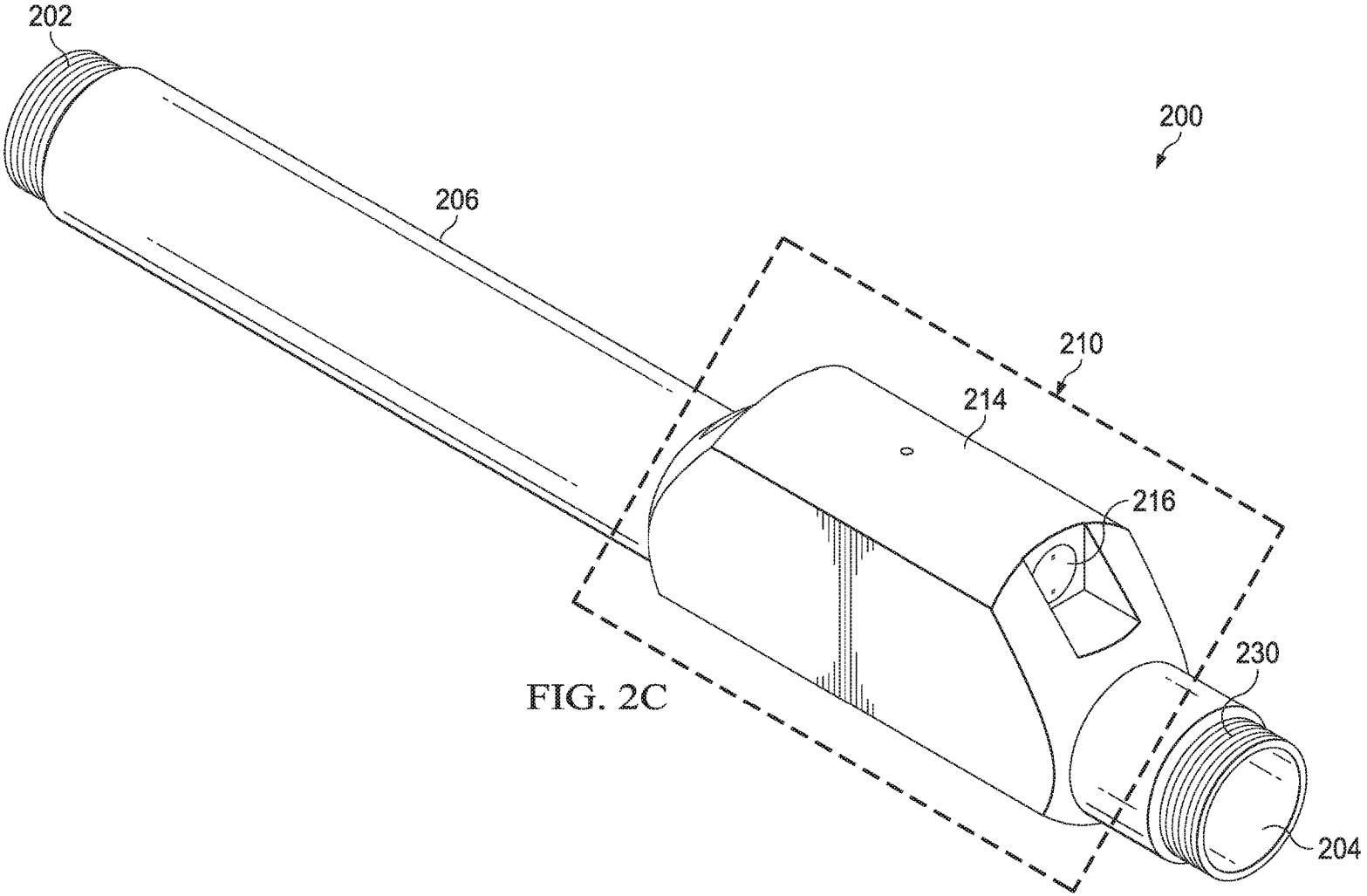
FIG. 2C shows a rear-racing perspective view of the chemical injection mandrel in accordance with one or more embodiments of the present invention.

FIG. 2A shows a front-facing perspective view of a chemical injection mandrel 200 in accordance with one or more embodiments of the present invention. Chemical injection mandrel 200 may include a mandrel 206 and a chemical injector 210 disposed around an exterior surface of the mandrel 206. Mandrel 206 may include a first threaded end 202 configured to connect to a distal end of production tubing (e.g., 126 of FIG. 1A) and a second threaded end 230 for potential connection to other equipment, such as, for example, a production packer (e.g., 168 of FIG. 1A). One of ordinary skill in the art will recognize that the equipment that may be connected to the second threaded end 230 may vary based on the application or design in accordance with one or more embodiments of the present invention. Mandrel 206 may include a hollow interior passageway 204 for fluid flow therein. Chemical injector 210 may include a housing 214 disposed about the exterior surface of mandrel 206. A chemical injection port 212 (partially shown) may be inserted into a portion of a first cavity (not independently illustrated) of housing 214 of chemical injector 210 and may be configured to receive a chemical injection line (e.g., 112 of FIG. 1). Continuing, FIG. 2B shows a side elevation view of the chemical injection mandrel 200 in accordance with one or more embodiments of the present invention. Continuing, FIG. 2C shows a rear-racing perspective view of the chemical injection mandrel 200 in accordance with one or more embodiments of the present invention. A bottom plug 216 (partially shown) may be inserted into a portion of a second cavity (not independently illustrated) of housing 214 of chemical injector 210.

Figure 3:
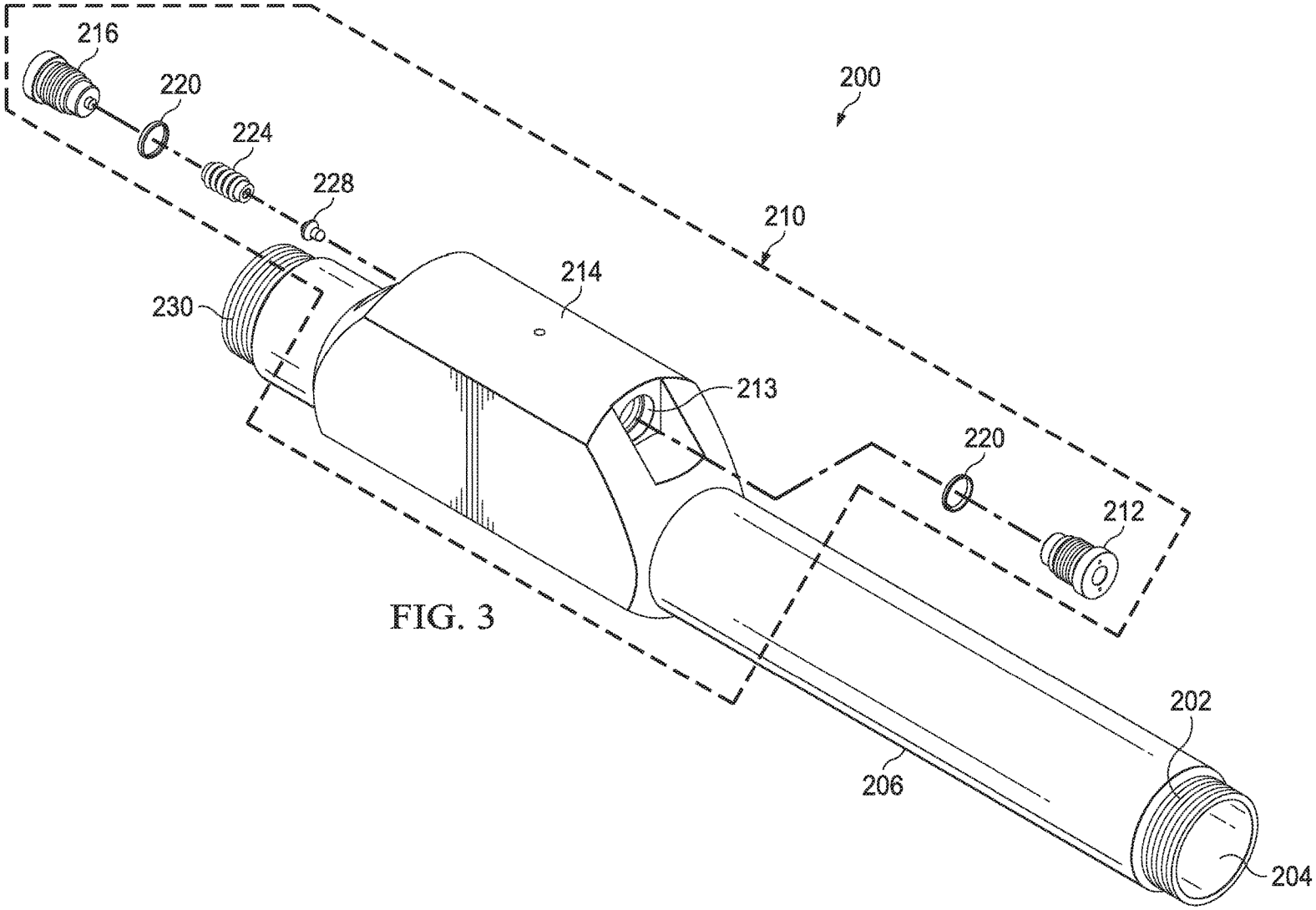
FIG. 3 shows an exploded front-facing perspective view of a chemical injector of a chemical injection mandrel in accordance with one or more embodiments of the present invention.

FIG. 3 shows an exploded front-facing perspective view of a chemical injector 210 of a chemical injection mandrel 200 in accordance with one or more embodiments of the present invention. Chemical injector 210 may include a housing 214 disposed about an exterior surface of mandrel 206. A chemical injection port 212 may be inserted into a first threaded opening 213 (partially shown) that extends into a portion of a first cavity (partially shown) of housing 214. A crush ring 220 may create a seal between chemical injection port 212 and first threaded opening 213 of housing 214 when chemical injection port 212 is fully inserted into first threaded opening 213. A first distal end of nitrogen-charged bellows 224 may be fixedly attached to bottom plug 216. A second distal end of a bellows 224 may be fixedly attached to a dart 228. The assembled bottom plug 216, bellows 224, and dart 228 subassembly (not shown) may be inserted into a second threaded opening (not shown) that extends into a portion of a second cavity (not shown) of housing 214. In certain embodiments, biasing means, such as, for example, a spring (not shown), a coil spring (not shown), a wave spring (not shown), or belleville washers (not shown) may be used instead of bellows 224. A crush ring 220 may create a seal between bottom plug 216 and the second threaded opening (not shown) of housing 214 when bottom plug 216 is fully inserted into the second threaded opening (not shown).

Figure 4A:
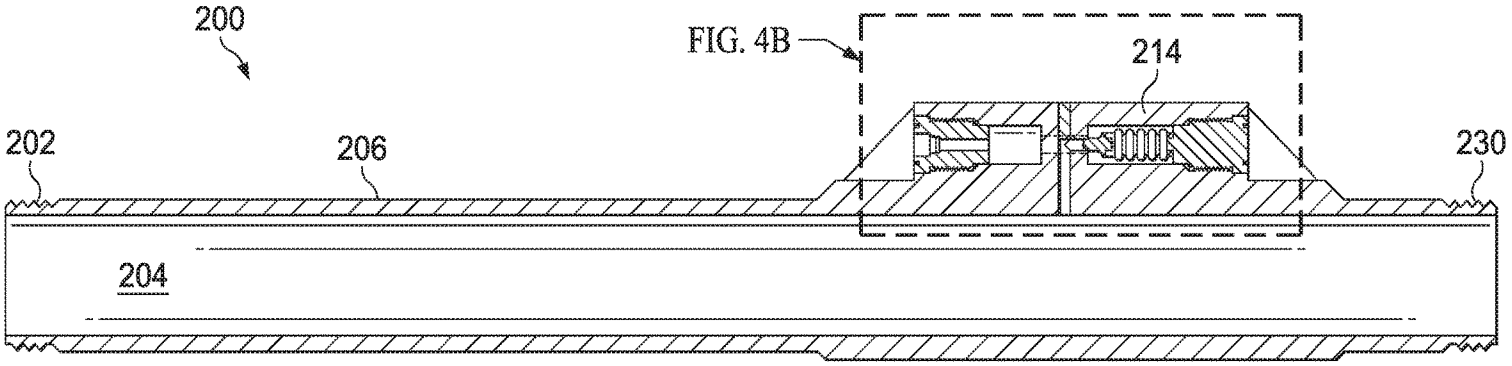
FIG. 4A shows a side cross-sectional view of a chemical injection mandrel in accordance with one or more embodiments of the present invention.
Figure 4B:
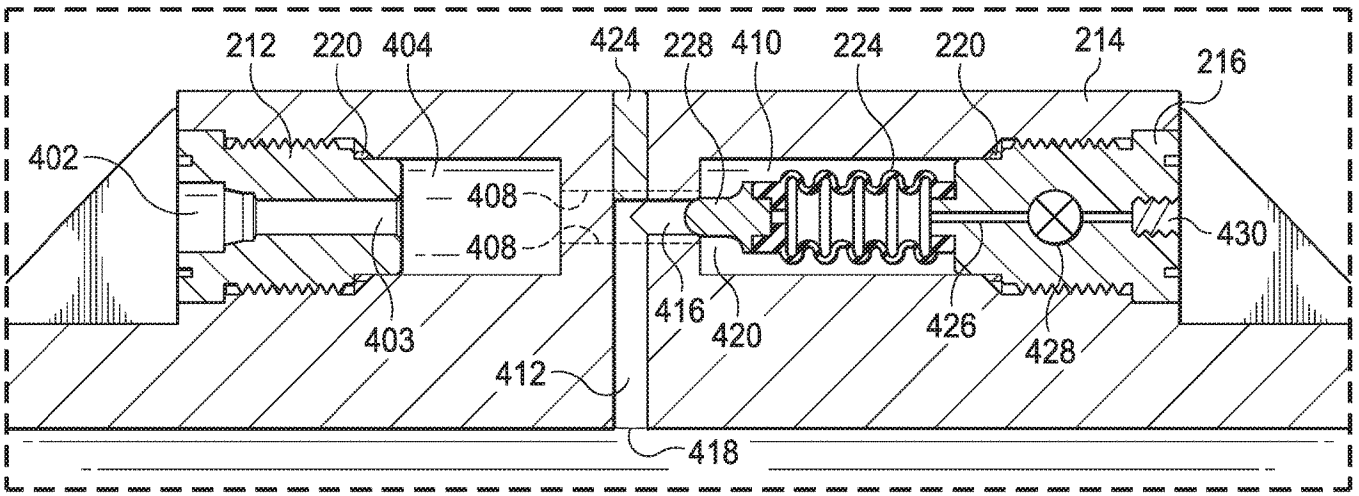
FIG. 4B shows a side cross-sectional detail view of a portion of a chemical injector of the chemical injection mandrel in accordance with one or more embodiments of the present invention.

FIG. 4A shows a side cross-sectional view of a chemical injection mandrel 200 in accordance with one or more embodiments of the present invention. In this view, hollow interior passageway 204, which extends from distal end to distal end, of mandrel 206 is shown. Continuing, FIG. 4B shows a side cross-sectional detail view of a portion of chemical injector 210 of chemical injection mandrel 200 in accordance with one or more embodiments of the present invention. Chemical injection port 212 may be configured to receive a chemical injection line (e.g., 112 of FIG. 1) that directs fluid flow (not shown) to an inlet end 402 of chemical injection port 212. Inlet end 402 may direct fluid flow (not shown) to an outlet end 403 that directs fluid flow (not shown) into a portion of a first cavity 404. One or more control ports 408 (shown as dashed lines in this cross-sectional view) may direct fluid flow (not shown) to a portion of a second cavity 410 that envelopes bellows 224. When the fluid pressure applied at chemical injection port 212 is less than a predetermined amount, bellows 224 may be in an uncompressed or biased state assisted by the pressure of the hydrostatic head and dart 228 is on seat, closing communication port 416, thereby preventing fluid flow (not shown) into a chemical outlet 412. When a predetermined amount of fluid pressure is applied (not shown) to chemical injection port 212, the fluid pressure within the portion of the second cavity 410 causes bellows 224 to compress, withdrawing dart 228 off seat, and opening communication port 416, thereby directing fluid flow (not shown) from communication port 416 to chemical outlet 412 and into the hollow interior passageway (e.g., 204 of FIG. 4A) of the mandrel (e.g., 206 of FIG. 4A) via a mandrel injection port 418. As such, communication port 416 may be controllably opened or closed based on an amount of fluid pressure applied to chemical inlet 402 of chemical injection port 212. A plug 424 may be used to seal the drill hole used to create chemical outlet 412. One of ordinary skill in the art will recognize that the predetermined amount of fluid pressure required to withdraw dart 228 may vary based on an application or design in accordance with one or more embodiments of the present invention. In addition, one of ordinary skill in the art will recognize that the predetermined amount of fluid pressure required to withdraw dart 228 may be controlled by varying one or more of the diameter of inlet end 402, the diameter of outlet end 403, the size and shape of first cavity 404, the size and shape of control ports 408, the size and shape of second cavity 410, and the characteristics of a type or kind of bellows 224 used.

Figure 4C:
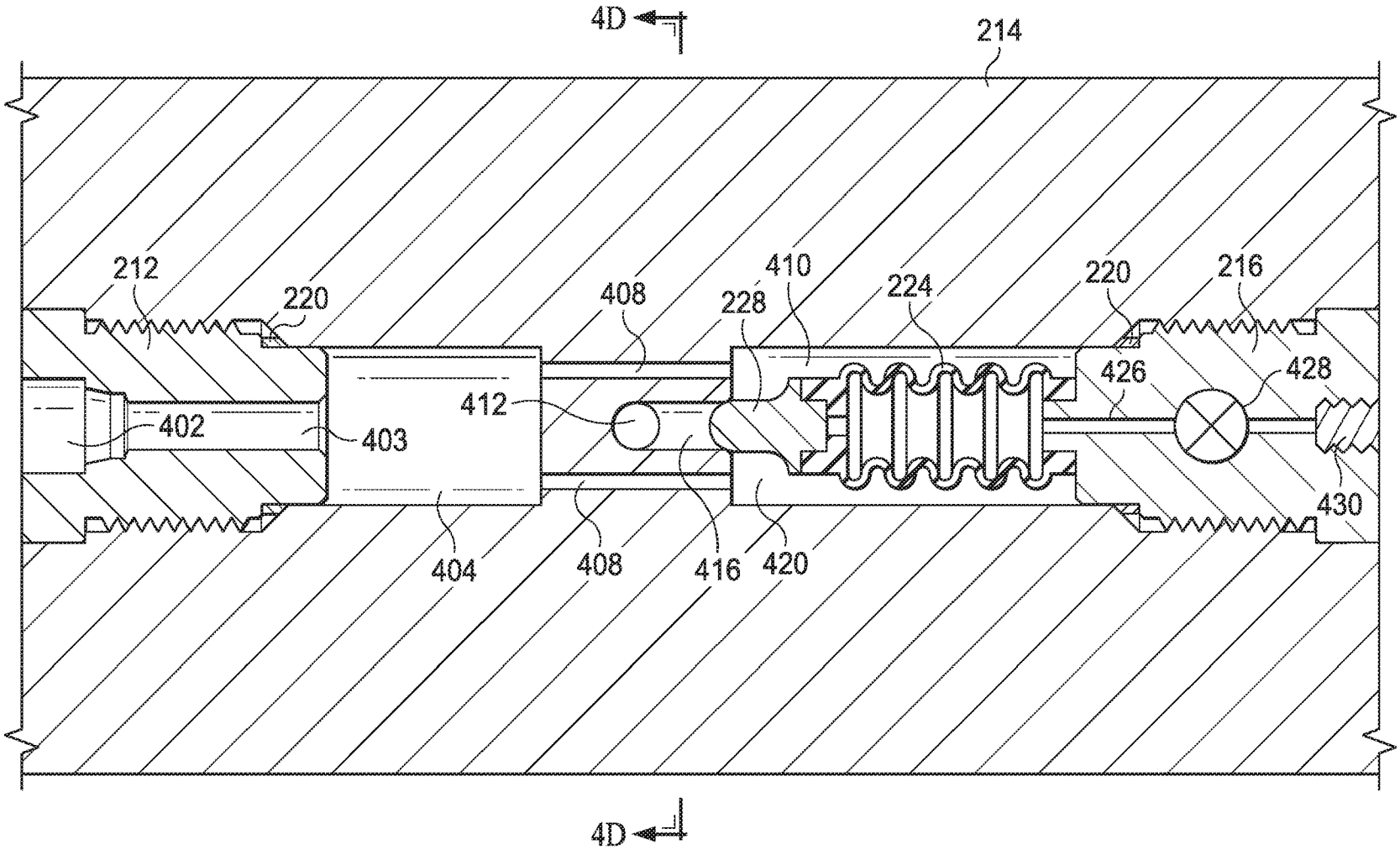
FIG. 4C shows a top cross-sectional view of the chemical injector of the chemical injection mandrel in accordance with one or more embodiments of the present invention.
Figure 4D:
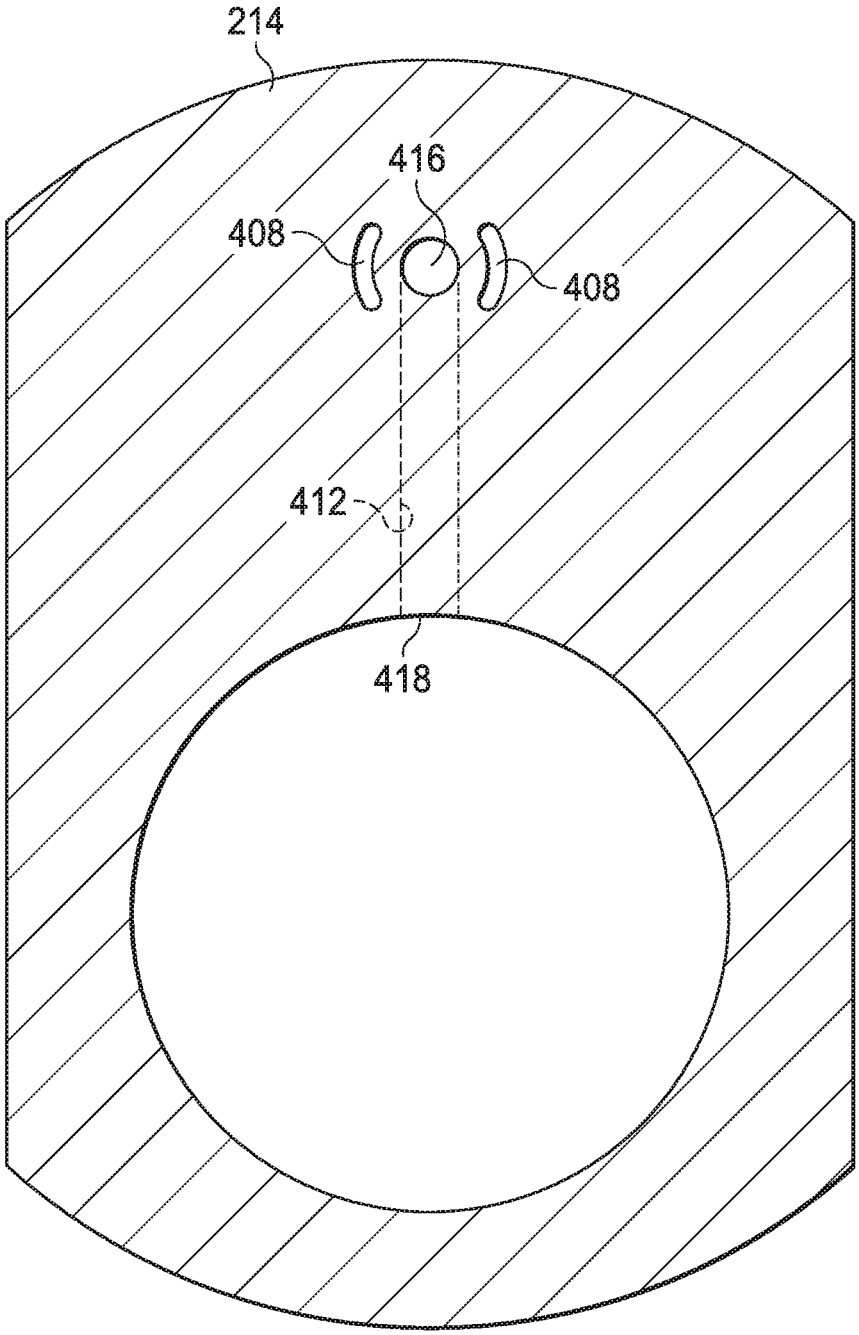
FIG. 4D shows a cross-sectional view of one or more control ports and a communication port of the chemical injector of the chemical injection mandrel in accordance with one or more embodiments of the present invention.

Continuing, FIG. 4C shows a top cross-sectional detail view of the portion of chemical injector 210 of chemical injection mandrel 200 in accordance with one or more embodiments of the present invention. In this view, the one or more control ports 408 that fluidly connect the first cavity 404 to the second cavity 410 are shown. In addition, a hemispherical interface between communication port 416 and chemical outlet 412 is shown. Continuing, FIG. 4D shows a cross-sectional view of one or more control ports 408 that fluidly connect the first cavity (not shown) and the second cavity (not shown) of the housing 214 and a communication port 416 of the chemical injector 210 of the chemical injection mandrel 200 in accordance with one or more embodiments of the present invention. In addition, ghost lines show chemical outlet 412 in relation to communication port 416. As noted above, in one or more embodiments of the present invention, there is a hemispherical interface between communication port 416 and chemical outlet 412.

Figure 5A:
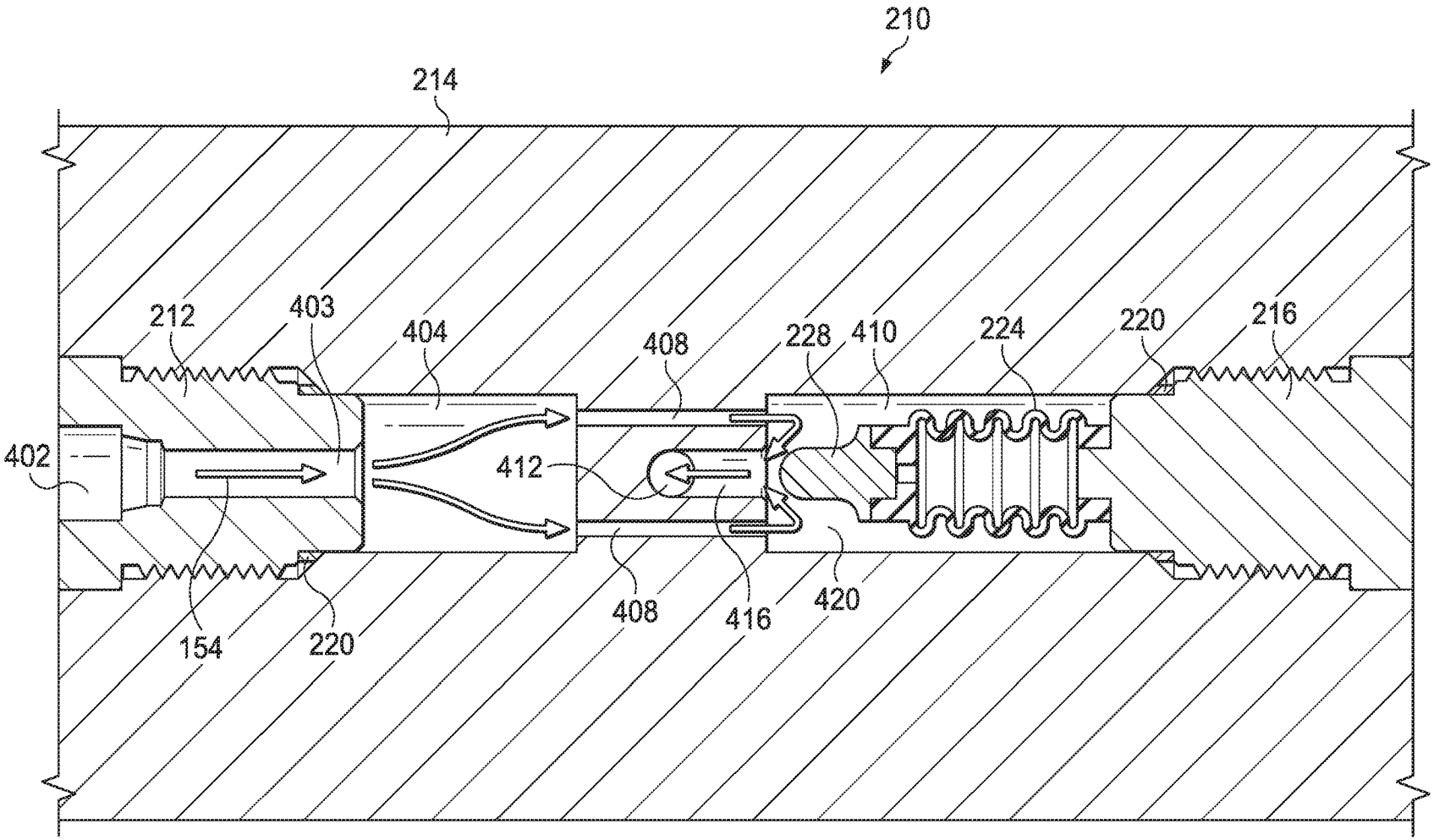
FIG. 5A shows a top cross-sectional detail view of a chemical injector of a chemical injection mandrel showing fluid communication in accordance with or more embodiments of the present invention.

FIG. 5A shows top cross-sectional detail view of a chemical injector 210 of a chemical injection mandrel 200 showing fluid communication in accordance with or more embodiments of the present invention. A chemical injection line (e.g., 112 of FIGS. 5B and 5C) may connect to an inlet end 402 of a chemical injection port 212 and may direct chemical fluid flow 154 under controllable pressure provided by a fluid system (not shown) disposed on, for example, a FPSO (e.g., 102 of FIG. 1A) on the surface of the water. Chemical fluid flow 154 may traverse the chemical injection port 212 from inlet end 402 to outlet end 403, where chemical fluid flow 154 may be directed to a portion of a first cavity 404 of housing 214 of chemical injector 210. Chemical fluid flow 154 may be directed from the portion of the first cavity 404 into one or more control ports 408 that fluidly connect the first cavity 404 to the second cavity 410. When the predetermined amount of fluid pressure is applied, the fluid pressure within the second cavity 410 may compress bellows 224, withdrawing dart 228 off seat and opening communication port 416 to chemical fluid flow 154.

Figure 5B:
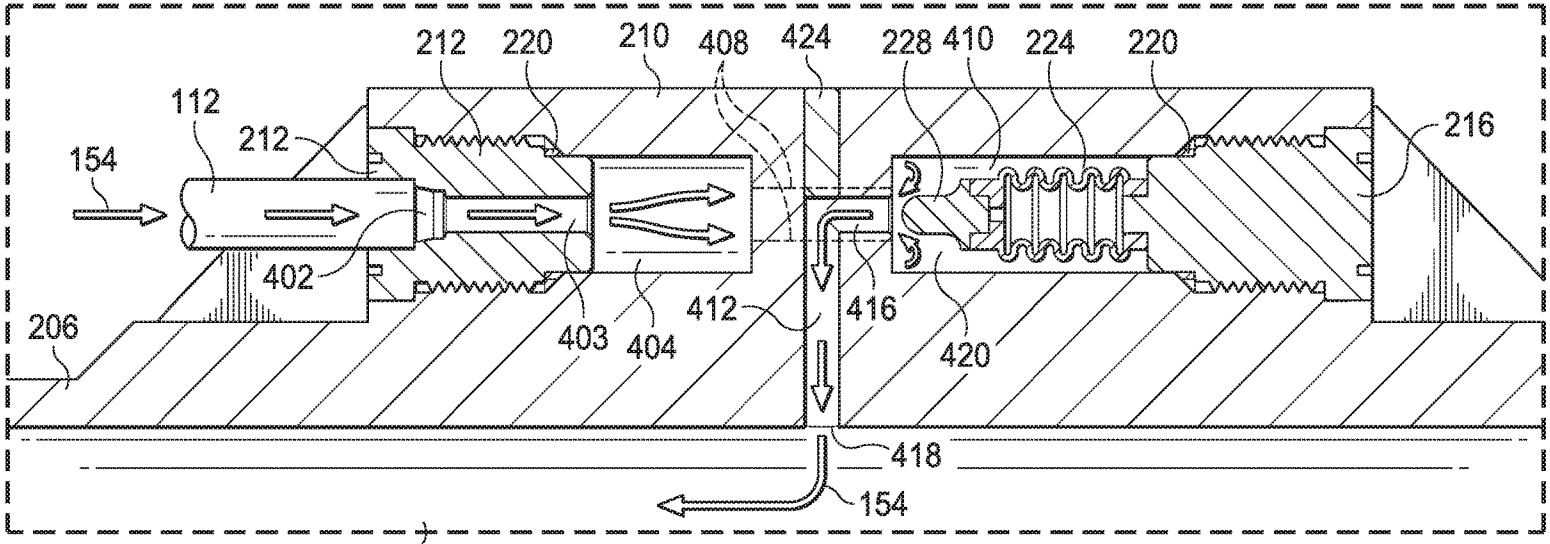
FIG. 5B shows a side cross-sectional detail view of the chemical injector of the chemical injection mandrel showing fluid communication in accordance with or more embodiments of the present invention.
Figure 5C:
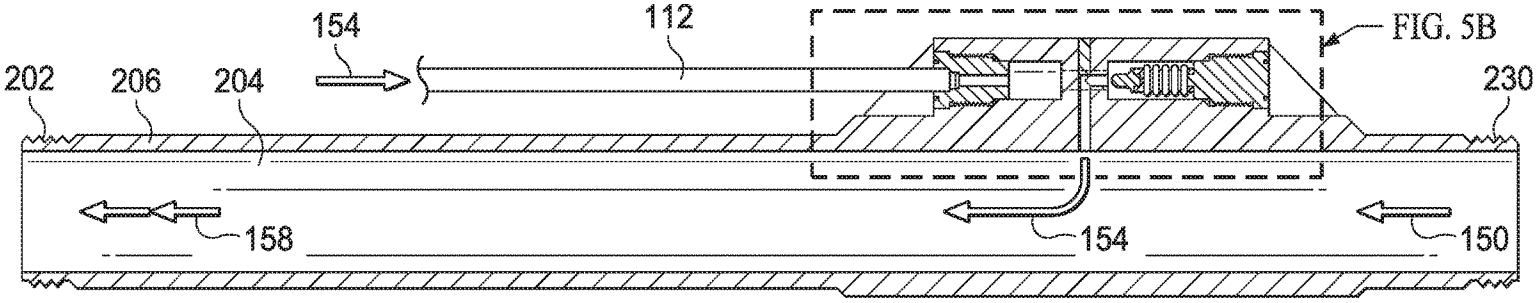
FIG. 5C shows a side cross-sectional view of the chemical injection mandrel showing fluid communication in accordance with or more embodiments of the present invention.

Continuing, FIG. 5B shows side cross-sectional detail view of chemical injector 210 of chemical injection mandrel 200 showing fluid communication in accordance with or more embodiments of the present invention. While dart 228 is off seat, chemical fluid flow 154 may be directed from communication port 416 to chemical outlet 412. Chemical outlet 412 may direct chemical fluid flow 154 into an interior passageway 204 of a mandrel 206 of chemical injection mandrel 200 via a mandrel injection port 418 that fluidly connects chemical outlet 412 and interior passageway 204 of mandrel 206. Continuing, FIG. 5C shows side cross-sectional view of the chemical injection mandrel 200 showing fluid communication in accordance with or more embodiments of the present invention. While dart 228 is off seat, chemical fluid flow 154 enters hollow interior passageway 204 of mandrel 206 and mixes with production flow 150 entering the bottomhole oriented distal end of mandrel 206. Chemical fluid flow 154 and production flow 150 mix and the production flow with injected chemicals 158 traverse and exit mandrel 206, up the production tubing (e.g., 126 of FIG. 1A) to the production flow line (e.g., 166 of FIG. 1A) that returns the fluids to the FPSO (e.g., 102 of FIG. 1A) on the surface for further processing or storage.

In one or more embodiments of the present invention, a method of injecting chemicals into a Lower Tertiary well may include connecting a chemical injection line between a fluid system and a chemical injector of a chemical injection mandrel. The chemical injection mandrel may be attached to a distal end of production tubing. The production tubing may be disposed in a wellbore. The chemical injection line may be disposed in the annulus between the production tubing and the wellbore. Fluid pressure may be applied to the chemical injection line to enable chemical fluid flow through the chemical injector of the chemical injection mandrel and into a hollow interior passageway of a mandrel of the chemical injection mandrel. Specifically, the application of fluid pressure in the chemical injection line may direct chemical fluid flow into an inlet end of a chemical injection port of the chemical injector of the chemical injection mandrel. Chemical fluid flow into the inlet end of the chemical injection port may direct chemical fluid flow from a first cavity of the chemical injector into a second cavity of the chemical injector by way of one or more control ports that fluidly connect the first cavity to the second cavity. Upon application of a predetermined amount of fluid pressure, fluid flow into the second cavity may cause a bellows of the chemical injector to compress and withdraws a dart from a communication port of the chemical injector, allowing chemical fluid flow from the second cavity into the communication port. Chemical fluid flow from the communication port may be directed to a chemical outlet port of the chemical injector and into a hollow interior passageway of the mandrel via a mandrel injection port. The chemical fluid flow into the mandrel injection port of the mandrel allows for chemical fluid flow to be mixed with production flow provided by formation fluids in the hollow interior passageway of the mandrel. The mixture of production flow and chemical fluid flow are directed up the production tubing towards the surface via a production flow line that returns fluids to the FPSO on the surface of the water.

Advantages of one or more embodiments of the present invention may include one or more of the following:

In one or more embodiments of the present invention, a method, apparatus, and system for injecting chemicals into a Lower Tertiary well allows for the efficient and controlled injection of chemicals into Lower Tertiary wells in a manner that is tubing pressure insensitive.

In one or more embodiments of the present invention, a method, apparatus, and system for injecting chemicals into a Lower Tertiary well allows the fluid flow rate of chemical injection to be controlled from the surface in a manner that is production tubing pressure insensitive. If the formation pressure falls and the formation syphons fluids, the fluid flow rate through the chemical injector is substantially unchanged. Advantageously, this prevents the formation from drinking large amounts of expensive chemicals and saves the attendant expense.

In one or more embodiments of the present invention, a method, apparatus, and system for injecting chemicals into a Lower Tertiary well uses a chemical injector disposed in the annulus between the production tubing and the wellbore. The chemical injection line that connects the fluids system disposed on the FPSO to the chemical injector disposed downhole is also disposed in the annulus. As such, the fluids system disposed on the surface may control the rate of chemical fluid flow by application of fluid pressure within the chemical injection line in a manner that is tubing pressure insensitive.

In one or more embodiments of the present invention, a method, apparatus, and system for injecting chemicals into a Lower Tertiary well uses a chemical injector that is normally closed and only opens when a predetermined amount of fluid pressure is provided from the surface. As such, the effect of downhole pressure is substantially reduced or eliminated, thereby preventing chemicals from inadvertently flowing into the formation when downhole pressures suddenly decrease. Advantageously, the fluid flow rate of chemicals can be controlled from the surface by application of fluid pressure.

In one or more embodiments of the present invention, a method, apparatus, and system for injecting chemicals into a Lower Tertiary well uses a chemical injector having a hemispherical interface between the communication port and the chemical outlet port.

In one or more embodiments of the present invention, a method, apparatus, and system for injecting chemicals into a Lower Tertiary well uses a chemical injector having a bellows that functions at extremely high temperatures and pressures.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A chemical injection mandrel for injecting chemicals comprising:

a mandrel comprising a hollow interior passageway and a mandrel injection port; and a chemical injector disposed on an exterior surface of the mandrel, the chemical injector comprising:

a housing comprising:

a first threaded opening that extends into a portion of a first cavity, a second threaded opening that extends into a portion of a second cavity, a control port that fluidly connects the first cavity to the second cavity, and a communication port that fluidly connects the second cavity to a chemical outlet port, a chemical injection port having an inlet end configured to receive fluid flow from a chemical injection line and an outlet end that directs the fluid flow to the control port, wherein the chemical injection port is inserted into the first threaded opening, a bottom plug inserted into the second threaded opening, and a bellows having a first distal end connected to the bottom plug and a second distal end connected to a dart configured to controllably open and close the communication port, wherein application of a predetermined amount of fluid pressure from the chemical injection line to the chemical injection port and the control port compresses the bellows and withdraws the dart from the communication port, allowing fluid flow to the chemical outlet port and into the hollow interior passageway of the mandrel via the mandrel injection port, and wherein the chemical injection mandrel is configured to be disposed on a distal or near-distal end of production tubing and the chemical injection line is configured to be disposed in an annulus between the production tubing and a wellbore.

2. The chemical injection mandrel of claim 1, further comprising a crush ring configured to create a seal between the chemical injection port and the first threaded opening when the chemical injection port is fully inserted into the first threaded opening.

3. The chemical injection mandrel of claim 1, further comprising a crush ring configured to create a seal between the bottom plug and the second threaded opening when the bottom plug is fully inserted into the second threaded opening.

4. The chemical injection mandrel of claim 1, wherein less than the predetermined amount of fluid pressure uncompresses the bellows and the dart closes the communication port, preventing fluid flow to the chemical outlet port.

5. A subsea system for injecting chemicals comprising:

a chemical injection mandrel disposed on a distal or near-distal end of production tubing; and a chemical injection line disposed in an annulus between the production tubing and a wellbore that fluidly connects a fluid system and a chemical injector of the chemical injection mandrel, wherein the chemical injection mandrel comprises:

a mandrel comprising a hollow interior passageway and a mandrel injection port, and the chemical injector disposed on an exterior surface of the mandrel, wherein the chemical injector comprises:

a housing comprising:

a first threaded opening that extends into a portion of a first cavity, a second threaded opening that extends into a portion of a second cavity, a control port that fluidly connects the first cavity to the second cavity, and a communication port that fluidly connects the second cavity to a chemical outlet port, a chemical injection port having an inlet end configured to receive fluid flow from the chemical injection line and an outlet end that directs the fluid flow to the control port, wherein the chemical injection port is inserted into the first threaded opening, a bottom plug inserted into the second threaded opening, and a bellows having a first distal end connected to the bottom plug and a second distal end connected to a dart configured to controllably open and close the communication port, wherein application of a predetermined amount of fluid pressure from the chemical injection line to the chemical injection port and control port compresses the bellows and withdraws the dart from the communication port, allowing fluid flow to the chemical outlet port and into the hollow interior passageway of the mandrel via the mandrel injection port.

6. The subsea system of claim 5, further comprising a crush ring configured to create a seal between the chemical injection port and the first threaded opening when the chemical injection port is fully inserted into the first threaded opening.

7. The subsea system of claim 5, further comprising a crush ring configured to create a seal between the bottom plug and the second threaded opening when the bottom plug is fully inserted into the second threaded opening.

8. The subsea system of claim 5, wherein less than the predetermined amount of fluid pressure uncompresses the bellows and the dart closes the communication port, preventing fluid flow to the chemical outlet port.

* * * * *